US005931663A

United States Patent [19]

Lewandowski et al.

[11] Patent Number: 5,931,663

[45] Date of Patent: Aug. 3, 1999

[54] PURGE SYSTEM FOR REGENERATIVE THERMAL OXIDIZER

[75] Inventors: David A. Lewandowski, Belle Vernon; Peter B. Nutcher, Canonsburg; Peter J. Waldern, Bridgeville, all of Pa.

[73] Assignee: Process Combustion Corporation, Pittsburgh, Pa.

[21] Appl. No.: 09/031,273

[22] Filed: Feb. 27, 1998

Related U.S. Application Data

[60] Provisional application No. 60/038,336, Feb. 27, 1997.

[51] Int. Cl.[6] ..... F27D 17/00

[52] U.S. Cl. ..... 432/181; 432/180; 422/178

[58] Field of Search ..... 432/72, 175, 179, 432/180, 181; 110/210, 211, 302, 303, 204; 422/173, 175, 178, 179

[56] References Cited

U.S. PATENT DOCUMENTS

| | | | |
|---|---|---|---|
| 1,739,973 | 12/1929 | Mambourg . | |
| 3,207,493 | 9/1965 | Swain | 263/15 |
| 3,764,259 | 10/1973 | Alexander, Jr. | 432/180 |
| 3,870,474 | 3/1975 | Houston | 23/277 C |
| 4,358,268 | 11/1982 | Neville | 432/180 |
| 4,528,012 | 7/1985 | Sturgill | 65/135 |
| 4,741,690 | 5/1988 | Heed | 431/7 |
| 5,057,010 | 10/1991 | Tsai | 432/179 |
| 5,161,968 | 11/1992 | Nutcher et al. | 432/179 |
| 5,240,403 | 8/1993 | McAnespie | 431/5 |
| 5,259,757 | 11/1993 | Plejdrup et al. | 432/181 |
| 5,279,235 | 1/1994 | Greco | 110/233 |
| 5,293,827 | 3/1994 | Nester et al. | 110/304 |
| 5,562,442 | 10/1996 | Wilhelm | 432/72 |
| 5,692,893 | 12/1997 | Houston | 432/181 |
| 5,730,945 | 3/1998 | Klobucar | 432/181 |
| 5,770,162 | 6/1998 | Niknafs | 432/180 |
| 5,832,770 | 10/1998 | Matros et al. | 432/181 |
| 5,888,063 | 3/1999 | Scott et al. | 432/181 |

*Primary Examiner*—Teresa Walberg
*Assistant Examiner*—Gregory A. Wilson
*Attorney, Agent, or Firm*—Webb Ziesenheim Logsdon Orkin & Hanson, P.C.

[57] ABSTRACT

A continuous system and method for purging waste gases from dual heat exchange beds associated with a regenerative thermal oxidizer are disclosed. The system includes a purge recovery tank, a stack open to the atmosphere, a stack bypass, a stack valve in the stack, and a stack bypass valve in the stack bypass. The purge recovery tank is in fluid communication with two heat exchange beds, the stack, and the stack bypass. The stack is in fluid communication with the stack bypass and the heat exchange beds. A purge recycle control valve is used to recycle untreated waste gases from the purge recovery tank to the heat exchange beds and into the regenerative thermal oxidizer. A second embodiment wherein the purge recovery tank is positioned between the two heat exchange beds is also disclosed.

12 Claims, 3 Drawing Sheets

PURGE SYSTEM FOR REGENERATIVE THERMAL OXIDIZER

CROSS-REFERENCE TO RELATED APPLICATION

This application claims the benefit of U.S. Provisional Patent Application Ser. No. 60/038,336 filed Feb. 27, 1997, entitled "Purge System for Regenerative Thermal Oxidizer".

BACKGROUND OF THE INVENTION

1. Field of the Invention

This invention relates to regenerative thermal oxidizers and, particularly, a continuous system for purging waste gases from dual heat exchange beds associated with a regenerative thermal oxidizer.

2. Description of Prior Art

Regenerative incinerator systems are used to treat waste gases containing volatile organic compounds (VOC's), which are preferably incinerated before exhausting the treated waste gases to the atmosphere. Additionally, regenerative incinerator systems serve to eliminate undesirable odors present in untreated waste gases before venting to the atmosphere.

Regenerative incinerator systems typically include regenerative thermal oxidizers and waste gas purge recovery tanks as part of the combustion cycle. The purge recovery tank or other similar means is used to collect untreated waste between combustion cycles of the system. The concept of collecting untreated waste gases from heat exchange beds associated with a regenerative thermal oxidizer into a purge recovery tank between combustion cycles is well known. It is also common to recycle these untreated waste gases to the regenerative thermal oxidizer to complete their incineration. One such system is disclosed in U.S. Pat. No. 3,870,474 to Houston.

The Houston patent teaches using a partially evacuated surge chamber with suitable valving to collect contaminated air from a regenerative incinerator, when the air flow through the regenerative incinerator is reversed. A check valve prevents outside air from entering the surge chamber while contaminated air is being drawn into the surge chamber from the regenerative incinerator. A vacuum pump or other similar means is used to remove the contaminated air from the surge chamber. The evacuated contaminated air from the surge chamber is recycled back to the inlet for the regenerative incinerator and into a combustion chamber to complete the incineration of the contaminates contained in the waste gases. The purified air is then mixed with the main air flow for discharge from the system to the atmosphere.

The arrangement disclosed by Houston is a closed system. One of the drawbacks with a closed system is that pressure is permitted to build in the purge recovery tank between combustion cycles of the regenerative thermal oxidizer. Additionally, a vacuum pump or other similar means is required to empty the contents of the surge chamber and recycle any untreated waste gases for re-combustion. Further, a check valve is required to prevent the drawing in of atmospheric air through a vent stack when the vacuum pump is activated. This additional equipment leads to unnecessary costs, space requirements and maintenance.

U.S. Pat. No. 4,741,690 to Heed teaches a similar method for treating waste gases. The Heed patent discloses an arrangement having a storing device for receiving untreated waste gases from a combustor and two check valves to prevent the escape of untreated waste gases from the system.

The arrangement taught by the Heed patent requires a fan to empty the contents of the storage device and reintroduce purged, untreated waste gases to the combustor.

It is therefore an object of the invention to overcome the above-discussed disadvantages by providing a continuous open system for the removal of waste gases from a regenerative thermal oxidizer having two (2) heat exchange beds.

It is a further object of the invention to provide a second, compact embodiment which provides savings in material costs and enhances the overall thermal efficiency of the regenerative thermal oxidizer.

SUMMARY OF THE INVENTION

Accordingly, we have invented a continuous open system for purging waste gases from regenerative thermal oxidizers having dual heat exchange beds. At least one purge recovery tank is preferably in fluid communication with two heat exchange beds, a stack open to the atmosphere, a stack bypass and the main waste gas feed to the heat exchange beds and the regenerative thermal oxidizer. The stack is preferably in fluid communication with the stack bypass and the heat exchange beds.

A stack valve is preferably located in the stack, and a stack bypass valve is preferably located in the stack bypass. The stack valve and stack bypass valve can be butterfly valves. A purge recycle control valve is preferably located in the conduit between the at least one purge recovery tank and the main waste gas feed to the heat exchange beds and the regenerative thermal oxidizer.

The purge recovery tank may include baffles. The purge recovery tank may be positioned adjacent to the heat exchange bed such that the heat exchange bed conducts heat to the purge recovery tank. The purge recovery tank may be positioned so that the purge recovery tank and at least one of the heat exchange beds share a common wall.

In an alternative embodiment, the at least one purge recovery tank is positioned between the two heat exchange beds, so that the at least one purge recovery tank shares two common walls with the heat exchange beds and each of the heat exchange beds conducts heat to the at least one purge recovery tank.

A method for purging regenerative thermal oxidizers having dual heat exchange beds includes the steps of:

Providing at least one purge recovery tank, a stack open to the atmosphere, a stack bypass, a stack valve in the stack, and a stack bypass valve in the stack bypass, wherein the at least one purge recovery tank is in fluid communication with two heat exchange beds, the stack, the stack bypass and the main waste gas feed to the two heat exchange beds, and wherein the stack is in fluid communication with the stack bypass and the two heat exchange beds; reversing flow through the heat exchange beds; closing the stack valve; opening the stack bypass valve; forcing untreated waste gases from a first one of the heat exchange beds into the at least one purge recovery tank; substantially simultaneously forcing the treated waste gases in the at least one purge recovery tank out of the stack through the stack bypass; closing the stack bypass valve such that the untreated waste gases received by the at least one purge recovery tank remain in the at least one purge recovery tank; opening the stack valve; recycling the untreated waste gases received in the at least one purge recovery tank to the main waste gas feed; and drawing treated waste gases into the purge recovery tank from the first one of the heat exchange beds.

Further details and advantages of the invention will become apparent from the following detailed description, in conjunction with the drawings.

DETAILED DESCRIPTION OF THE PREFERRED EMBODIMENTS

Figure 1:
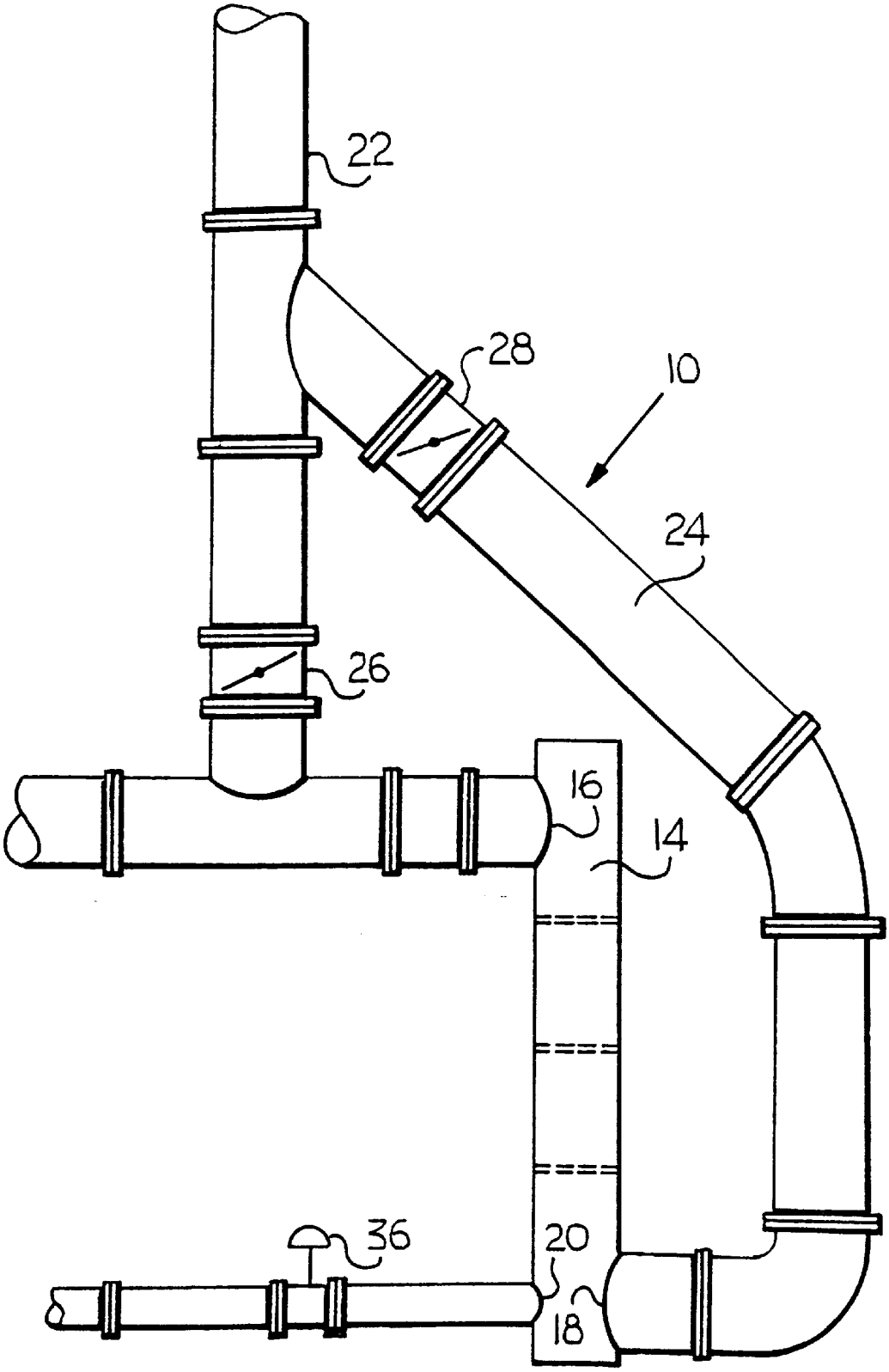
FIG. 1 is a schematic view of a continuous system for purging waste gases according to the present invention.
Figure 2:
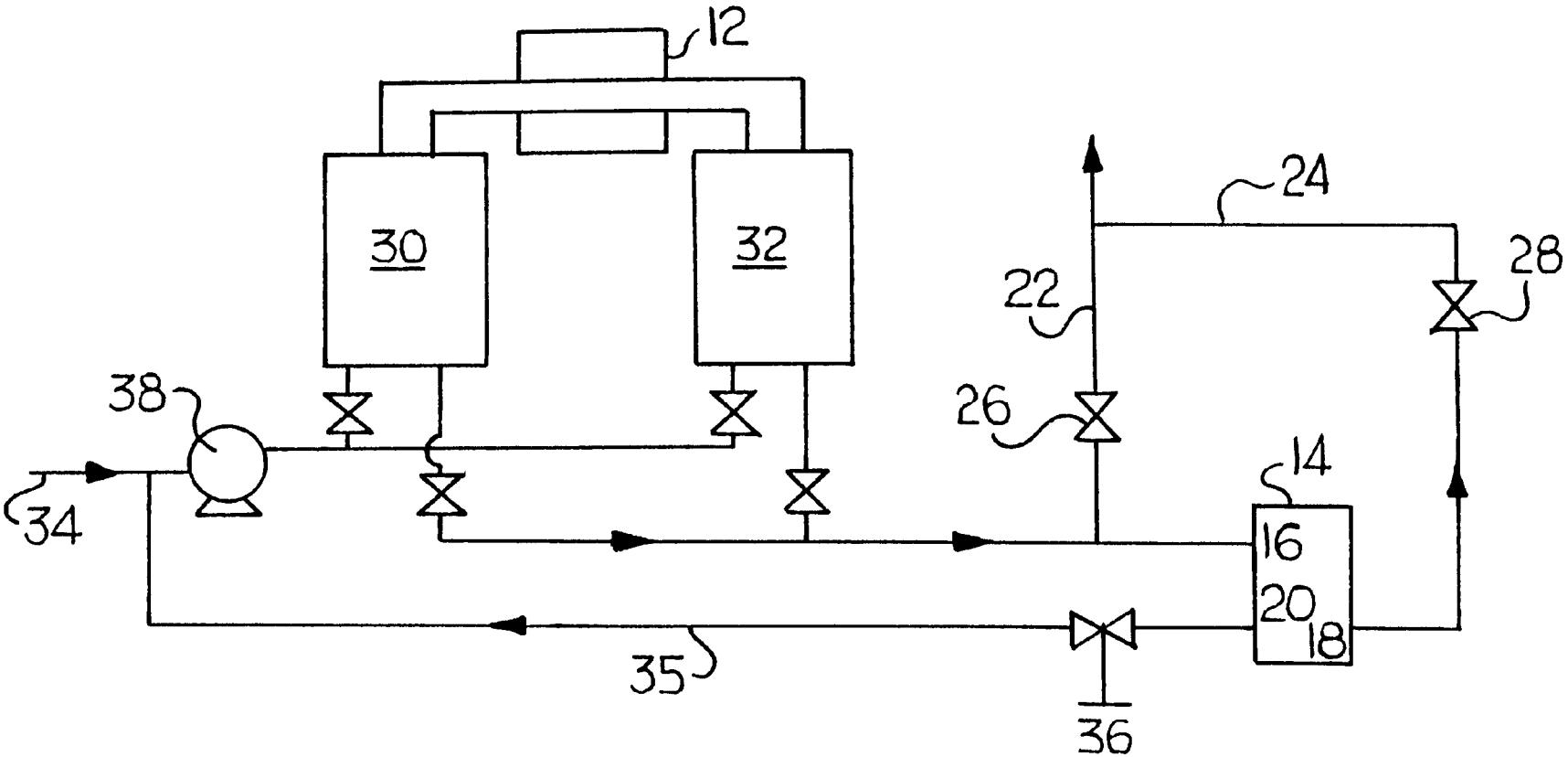
FIG. 2 is a schematic view of the continuous system for purging waste gases showing flow directions.

FIGS. 1 and 2 show a continuous system 10 for purging waste gases from dual heat exchange beds associated with a regenerative thermal oxidizer 12. Referring to FIG. 1, a purge recovery tank 14 is shown having an inlet 16, a first outlet 18 and a second outlet 20. A stack 22 is connected to the inlet 16 of the purge recovery tank 14. A stack bypass 24 connects the stack 22 to the first outlet 18 of the purge recovery tank 14. A stack valve 26 is located in the stack 22 between the inlet 16 and the junction of the stack 22 and the stack bypass 24. The stack valve 26 includes a shut-off valve such as a butterfly valve. A stack bypass valve 28 is located in the stack bypass 24 between the first outlet 18 of the purge recovery tank 14 and the junction of the stack 22 and the stack bypass 24. The stack valve 26 may be a butterfly valve. The stack 22 with the stack valve 26 in an open position is open to the atmosphere.

FIG. 2 shows the stack 22 connected to heat exchange beds 30 and 32. The second outlet 20 of the purge recovery tank 14 is connected to the main waste gas feed 34 to heat exchange beds 30 and 32 and the regenerative thermal oxidizer 12. A purge recycle control valve 36 is located between the second outlet 20 of the purge recovery tank 14 and the main waste gas feed 34. All motive forces are provided by an existing forced air fan 38 of the regenerative incinerator system. The regenerative thermal oxidizer according to the invention has preferably no more than two (2) heat exchange beds 30 and 32.

Referring again to FIG. 1, the purge recycle control valve 36 is shown in the conduit connecting to the second outlet 20 of the purge recovery tank 14.

Figure 3:
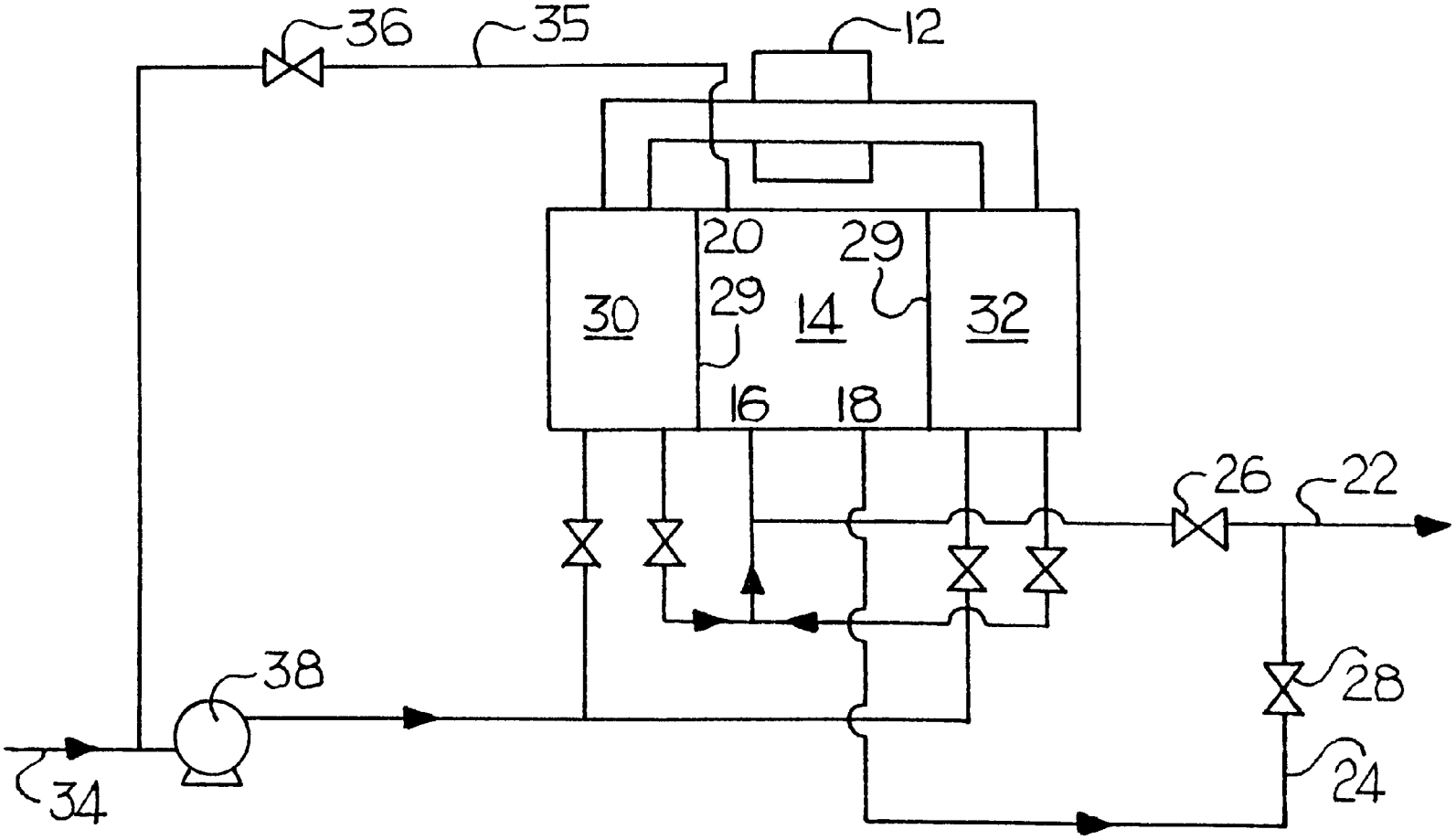
FIG. 3 is a schematic view of a continuous system for purging waste gases showing a second embodiment of the invention.

FIG. 3 shows a second embodiment of the continuous system 10 for purging waste gases from dual heat exchange beds associated with the regenerative thermal oxidizer 12, wherein like reference numbers designate like parts. The only difference between the second embodiment and the first embodiment is that in the second embodiment the purge recovery tank 14 is located between heat exchange beds 30 and 32. The purge recovery tank 14 is arranged between heat exchange beds 30 and 32 so that the vertical walls 29 of heat exchange beds 30 and 32 are shared by the purge recovery tank 14. This arrangement serves to keep the overall size of the regenerative thermal oxidizer 12 to a minimum, saving in space and material costs.

Additionally, this embodiment of the invention enhances overall thermal efficiency. The waste gases inflowing to the purge recovery tank 14 are relatively high temperature. As a result of placing the purge recovery tank 14 between heat exchange beds 30 and 32, some of this heat will be retained when the residual waste gases present in the purge recovery tank 14 are recycled to the main waste gas feed 34, thereby enhancing the overall thermal efficiency of the system. All motive forces for this embodiment are likewise provided by the existing forced air fan 38 of the regenerative incinerator system.

In operation, at the end of the combustion cycle of the regenerative thermal oxidizer 12 when, for example, one heat exchange bed 30 has reached a predetermined maximum temperature, the flow through heat exchange beds 30 and 32 is reversed in a known manner. The stack valve 26 is closed and the stack bypass valve 28 is opened, forcing untreated waste gases in heat exchange bed 30 into the purge recovery tank 14 through the inlet 16. This simultaneously forces the existing contents (treated exhaust) of the purge recovery tank 14 out of the stack 22 through the stack bypass 24. The stack valve 26 and the stack bypass valve 28 are operated so that waste gases are allowed to flow into the purge recovery tank 14 for a predetermined period of time, which is dependent on the flow rate into the purge recovery tank 14, the size of the inlet 16 to the purge recovery tank 14, the dimensions of the purge recovery tank 14, and the dimensions of heat exchange beds 30 and 32.

The purge recovery tank 14 is sized large enough and has sufficient volume so that waste gases from one or the other of heat exchange beds 30 and 32 can be completely introduced into the purge recovery tank 14 at the end of each combustion cycle of the regenerative thermal oxidizer 12. The purge recovery tank 14 may include baffles (not shown) configured to ensure the complete intake and exhaustion of waste gases into and out of the purge recovery tank 14 at the end of each combustion cycle. The dimensions of the purge recovery tank 14 and the time period for allowing waste gases to flow into the purge recovery tank 14 are chosen to prevent exhausting waste gases containing volatile organic compounds (VOC's) through the stack 22 prematurely before the closure of the stack bypass valve 28. The stack bypass valve 28 is closed after the preselected period of time has elapsed and the stack valve 26 is reopened.

During the ensuing combustion cycle of the regenerative thermal oxidizer 12, waste gases retained in the purge recovery tank 14 are mixed via recycle duct 35 at a controlled rate by the purge recycle control valve 36 with the main waste gas feed 34 upstream of fan 38. At the same time, treated combustion products from heat exchange bed 30 are drawn into the purge recovery tank 14. Purging cycles are repeated in coordination with the regular combustion cycles of heat exchange beds 30 and 32. All motive forces are provided by the existing forced air fan 38 of the regenerative incinerator system. No additional vacuum pumps or check valves are required for the process.

Referring again to FIG. 3, the second embodiment operates in a similar manner to the first embodiment, except for the placement of the purge recovery tank 14 between heat exchange beds 30 and 32.

While the preferred embodiments and presently known best mode of the invention have been described above, various modifications and variations of the invention may be made without departing from the spirit and scope of the invention.

What is claimed is:

1. A purge system for a regenerative thermal oxidizer, comprising:

a main waste gas feed into the thermal oxidizer;

a fan;

at least one purge recovery tank;

a stack;

a stack bypass;

a stack valve in the stack;

a stack bypass valve in the stack bypass;

at least one purge recovery tank in fluid communication with two heat exchange beds, the stack, and the stack bypass, wherein the stack is in fluid communication with the stack bypass and the heat exchange beds; and a recycle duct connecting the purge recovery tank with the main waste gas feed.

2. The purge system for a regenerative thermal oxidizer of claim 1, including a purge recycle control valve located in the recycle duct for controlling the recycling of purge recovery tank contents to the main waste gas feed.

3. The purge system for a regenerative thermal oxidizer of claim 1, wherein the stack valve is a butterfly valve.

4. The purge system for a regenerative thermal oxidizer of claim 1, wherein the stack bypass valve is a butterfly valve.

5. The purge system for a regenerative thermal oxidizer of claim 1, including the at least one purge recovery tank positioned adjacent to at least one of the heat exchange beds so that the heat exchange bed transfers heat to the purge recovery tank.

6. The purge system for a regenerative thermal oxidizer of claim 5, wherein the at least one purge recovery tank and at least one of the heat exchange beds share a common wall.

7. A method for purging a regenerative thermal oxidizer, comprising the steps of:

a) providing at least one purge recovery tank, a stack, a stack bypass, a stack valve in the stack, and a stack bypass valve in the stack bypass, wherein the at least one purge recovery tank is in fluid communication with two heat exchange beds, the stack, the stack bypass and a main waste gas feed, and wherein the stack is in fluid communication with the stack bypass and the at least one heat exchange bed;

b) reversing flow through the heat exchange beds;

c) closing the stack valve;

d) opening the stack bypass valve;

e) forcing untreated waste gases in a first heat exchange bed into the at least one purge recovery tank and substantially simultaneously forcing the contents of the at least one purge recovery tank out of the stack through the stack bypass;

f) closing the stack bypass valve such that the untreated waste gases received by the at least one purge recovery tank remain in the at least one purge recovery tank;

g) opening the stack valve;

h) recycling the untreated waste gases received in the at least one purge recovery tank to the main waste gas feed; and i) drawing treated waste gases from the first heat exchange bed into the at least one purge recovery tank.

8. The method for purging a regenerative thermal oxidizer of claim 7, including the step of repeating steps b-i in accordance with at least one heat exchange bed combustion cycle.

9. The method for purging a regenerative thermal oxidizer of claim 7, including the step of controlling the recycling of the untreated waste gases received in the at least one purge recovery tank to the main waste gas feed with a purge recycle control valve.

10. A purge system for a regenerative thermal oxidizer, comprising:

a purge recovery tank including an inlet, a first outlet and a second outlet, the inlet to the purge recovery tank connected to two heat exchange beds, the second outlet of the purge recovery tank connected to a main waste gas feed, via a recycle duct;

a stack connected to the inlet for the purge recovery tank and to the heat exchange beds;

a stack bypass connecting the stack to the first outlet of the purge recovery tank;

a stack valve located in the stack between the inlet to the purge recovery tank and a junction of the stack and the stack bypass;

a stack bypass valve located in the stack bypass; and a purge recycle control valve located in the recycle duct between the second outlet of the purge recovery tank and the main waste gas feed.

11. The purge system for a regenerative thermal oxidizer of claim 10, wherein the purge recovery tank is positioned adjacent to at least one of the heat exchange beds so that the heat exchange bed may transfer heat to the purge recovery tank.

12. The purge system for a regenerative thermal oxidizer of claim 10, wherein the purge recovery tank and each of the heat exchange beds share a common wall.

* * * * *